US011572662B2

(12) United States Patent
Mansell et al.

(10) Patent No.: US 11,572,662 B2
(45) Date of Patent: Feb. 7, 2023

(54) TOW POINT INDEX

(71) Applicant: Caterpillar Paving Products Inc., Brooklyn Park, MN (US)

(72) Inventors: Todd W Mansell, Rogers, MN (US); Jonathan A Anderson, Maple Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 132 days.

(21) Appl. No.: 17/220,216

(22) Filed: Apr. 1, 2021

(65) Prior Publication Data

US 2022/0316149 A1 Oct. 6, 2022

(51) Int. Cl.
*E01C 19/00* (2006.01)
*E01C 19/48* (2006.01)

(52) U.S. Cl.
CPC ..... *E01C 19/004* (2013.01); *E01C 19/48* (2013.01)

(58) Field of Classification Search
CPC ..... E01C 19/004; E01C 19/48
USPC ..... 404/84.05–118
See application file for complete search history.

(56) References Cited

U.S. PATENT DOCUMENTS

| | | | | |
|---|---|---|---|---|
| 4,925,340 | A * | 5/1990 | Heiser | E01C 19/4873 404/75 |
| 7,470,082 | B2 | 12/2008 | Lloyd | |
| 8,070,385 | B2 | 12/2011 | Green | |
| 8,371,769 | B2 | 2/2013 | Worsley et al. | |
| 9,441,334 | B1 * | 9/2016 | Frelich | E01C 19/48 |
| 9,790,648 | B2 | 10/2017 | Buschmann et al. | |
| 2015/0063907 | A1 * | 3/2015 | Graham | E01C 23/07 715/745 |
| 2019/0177930 | A1 | 6/2019 | Ramb et al. | |
| 2019/0382967 | A1 * | 12/2019 | Kleinvachter | E01C 23/01 |

* cited by examiner

*Primary Examiner* — Raymond W Addie
(74) *Attorney, Agent, or Firm* — Schwegman, Lundberg & Woessner

(57) ABSTRACT

An asphalt paver may include a tractor and a screed configured for towing behind the tractor. The screed may include a tow arm secured to the tractor at an adjustable tow point. The paver may also include a monitoring system configured for monitoring and displaying the position of the adjustable tow point. The monitoring system may include a sensor arranged at or near the tow point for sensing the position of the tow point and a computing system in communication with the sensor for displaying the position of the adjustable tow point. A method of paving involving adjusting paving parameters to avoid or compensate for movement in the tow point is also provided.

20 Claims, 5 Drawing Sheets

TOW POINT INDEX

TECHNICAL FIELD

The present application relates generally to asphalt pavers. More particularly, the present application relates to systems and methods for monitoring tow point positions of a screed secured to a tractor of an asphalt paver. Still more particularly, the present application relates to systems and methods for controlling an asphalt paver based on tow point position information in an effort to limit and/or minimize tow point movement.

BACKGROUND

Asphalt paving is commonly performed with a free-floating screed towed behind a tractor. The free-floating screed may be secured to the tractor at one or more tow points. For example, a pair of tow arms may extend forward from the screed and along respective sides of the tractor. The tow arms may be pivotally secured to the tractor at respective tow points. In some cases, the tow points may be adjustable vertically along the tractor. In any case, the pivoting nature of the connection of the screed to the tractor provides for the free-floating nature of the screed.

The very nature of a free-floating screed can make it complicated to control. For example, an asphalt paving operator may consider several parameters and may make several respective adjustments to the asphalt paver before and/or during paving based on those parameters. For example, the operator may adjust the speed of the paver, the angle of attack of the screed, the rate of material delivery, and/or one of several other parameters. Due to the complicated and interrelated nature of the parameters and adjustments, some pavers may include automated systems for controlling the tow point in an effort to continually or periodically adjust the angle of the attack of the screed. In some situations, an operator's adjustment of paving parameters may cause the automated system to counteract or compensate for adjustments made by the paving operator. For example, where an operator increases the paver speed, the screed may create a thinner pavement depth/thickness and an automated tow point system may raise the tow point to compensate for the change in speed, thereby increasing the angle of attack of the screed and increasing the pavement thickness back to the thickness before the speed increase.

While the asphalt paver may provide this adjustment, the operator may not have visibility into the tow point position. That is, the machine may adjust the tow point to compensate for the speed increase, but the operator may not know whether the tow point changed or how much the tow point changed. Still other operator adjustments may cause an automated system to adjust the tow point position and the operator may not be able to witness the effect of the parameter adjustments on the tow point position.

SUMMARY

In one or more embodiments, an asphalt paver may include a tractor and a screed configured for towing behind the tractor. The screed may include a tow arm secured to the tractor at an adjustable tow point. The paver may also include a monitoring system configured for monitoring and displaying the position of the adjustable tow point. The monitoring system may include a sensor arranged at or near the tow point for sensing the position of the tow point and a computing system in communication with the sensor for displaying the position of the adjustable tow point.

A method of operating an asphalt paver may include operating the asphalt paver to receive loose asphalt, deliver the loose asphalt to the grade in front of a screed, and pull the screed to form an asphalt mat. The operating may include setting and/or adjusting an operating parameter including at least one of paver speed and conveyor delivery rate. The method may also include continually receiving a tow point index from a monitoring system and adjusting the operating parameter to limit fluctuations in the tow point index.

DETAILED DESCRIPTION

Figure 1:
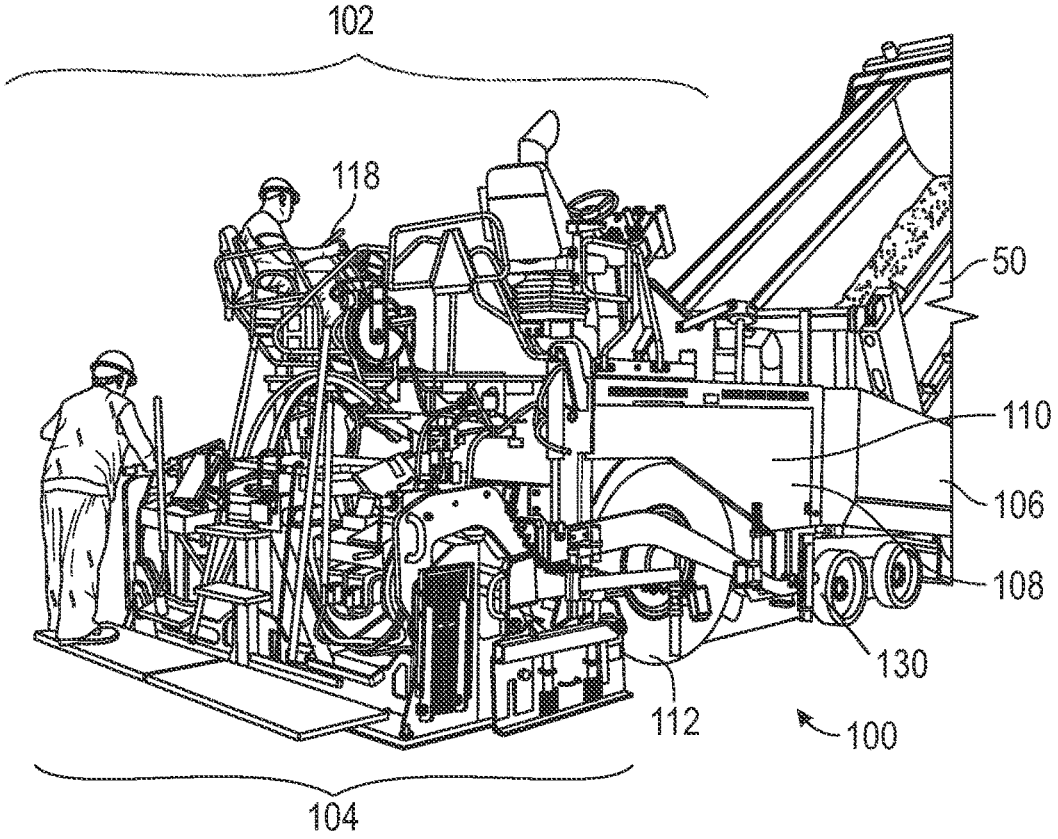
FIG. 1 is a perspective view of an asphalt paver, according to one or more embodiments.

FIG. 1 is a perspective view of an asphalt paving machine 100. As shown, the asphalt paving machine or, more simply, paving machine 100 may include a tractor 102 and a screed 104. On the right side of FIG. 1, a dump truck 50 is shown dumping loose asphalt into a hopper 106 on the tractor 102. A series of trucks 50 may be used to continually and/or periodically provide loose asphalt from an asphalt plant to the paving machine 100 during a paving operation.

The tractor 102 may be relatively central to the paving operation and may be configured for receiving loose asphalt from dump trucks 50, delivering the asphalt to the ground in a controlled manner, and for providing power to move the tractor 102, the dump truck 50, and the screed 104 along the ground surface at a controlled speed. For mobility purposes, the tractor 102 may include a frame 108, an engine 110, and a traction device 112. For asphalt receiving purposes, the tractor 102 may include a hopper 106. Still further, for asphalt delivery purposes, the tractor 102 may include one or more conveying systems such as a conveyor 114 (see FIG. 7) for pulling asphalt off a bottom of the hopper 106 and conveying it rearward and one or more augers 116 (see FIG. 7) for spreading the asphalt laterally in front of the screed 104. The engine 110 may provide power to the conveying systems as well. The tractor 102 may also include an operator station 118 providing displays or other interfaces for a user as well as control systems such as levers, switches, joysticks, and the like.

Figure 2:
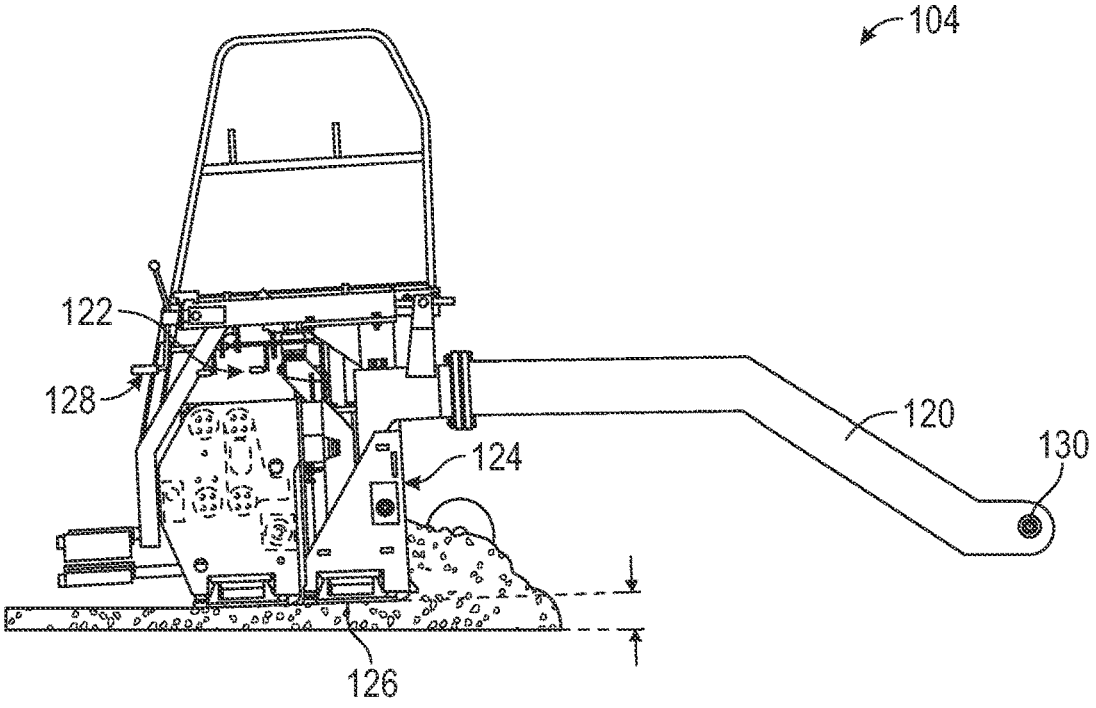
FIG. 2 is a side view of a screed, according to one or more embodiments.

The screed 104 may be pulled behind the tractor 102 and may function to smooth out the loose asphalt to create a layer of asphalt on the ground behind the traveling asphalt paver 100. The screed may be configured to create a mat of asphalt that has a relatively smooth surface and has a substantially uniform thickness and a substantially uniform width. As shown FIG. 2, the screed 104 may include a screed arm 120 extending from the tractor to a screed frame 122. The screed 104 may also include a strike off plate 124 on a front side of the frame 122 and a screed plate 126 along the bottom of the frame 122. In one or more embodiments, a depth control crank 128 may be provided to adjust the angle of the screed elements to the screed arm 120. It is to be appreciated that, while not described in detail here, several other parts of a screed 102 may be provided such as a heating mechanism, a vibration device, a personnel platform, railings, end plates, screed extensions, and other features.

The screed arm 120 may be configured for attachment to the tractor 102 at a tow point 130. In particular, the screed arm 120 may include a pair of screed arms 120 configured for attachment to respective sides of the tractor 102 at respective tow points 130. Each of the screed arms 120 may be relatively long, slender, and rigid arms adapted to tie the screed 104 to the tractor 102 and tow the screed 104 behind the tractor 102. The screed arms 120 may have a tow point end and a screed end and may be secured to the tractor at the tow point end and to the screed at the screed end. The connection between the screed arm 120 and the tractor 102 may be a pivoting connection, such as a pinned connection, at a tow point 130 and the connection to the screed 104 at the screed end may be a relatively rigid connection at or near a side of the screed 104 as shown. In other embodiments, the connection at the screed end may be a pivoting connection as well, where the pivoted position of the screed 104 relative to the screed arms 120 is controlled or adjustable by a depth control crank 128. Where a rigid connection between the screed arm and the screed is provided, a depth control crank 128 may be associated with a pivoting mechanism internal to the screed 104 to allow for the screed 104 to be pivoted relative to the screed arm 120. Still other approaches to controlling and/or adjusting the pivoted position of the screed 104 relative to the screed arms 120 may be provided. In one or more embodiments, the screed arms 120 may be spaced apart by a distance adapted to receive the tractor 102 between the screed arms 120 and attached to tow points 130 along the sides of the tractor 102.

The frame 122 of the screed 104 may be configured to distribute the pulling forces of the screed arms 120 across the back of the paving machine 100 to provide a relatively rigid framework for screeding the pavement. The frame 122 may also be configured to provide a substantially uniform down force on the pavement as the loose asphalt passes below the screed. As such, the frame 122 may be constructed of relatively rigid beams, truss structures, or plate structures adapted to resist out of plane bending about both a vertical and a horizontal axis. The frame 122 may be secured to the screed arms 120 at or near each side of the frame with a pivoting or rigid connection. In the case of a pivoting connection, a control mechanism for adjustably controlling the pivoted position of the frame relative to the screed arms may be provided. For example, the mentioned depth control crank 128 may include a crank for adjusting the pivoted angle of the frame 122 relative to the screed arms 120, for example.

The strike off plate 124 may be arranged along a front side of the frame 122 and may be adapted to advance or push the asphalt material laid on the ground by the tractor 102. That is, while a portion of the material laid on the ground may pass beneath the screed 104, a large majority of the material may be advanced along the ground until it passes beneath the screed 104. Moreover, material may be continually laid down in front of the screed 104 in an effort to maintain a consistent selected head of material in front of the screed 104 and the strike off plate 124 may continually interact with the head of material to advance the head of material along the ground surface.

The screed plate 126 may be arranged on a bottom side of the frame 122. The screed plate 126 may be adapted to smooth out and initially press on the loose asphalt material to establish a roadway surface. The pivoting position of the frame 122 may determine the angle of the screed plate 126, which may define an angle of attack relative to a ground surface on which the mat of asphalt is being applied. In one or more embodiments, the screed plate 126 may be a vibratory screed plate and/or a heated a screed plate.

With the details of the screed 104 described, we may now turn back to a discussion of the control system 132 of the tractor that functions to operate the asphalt paver as a whole. For example, the tractor may be equipped with a control system 132 such as an electronic control module (ECM) adapted to control the several features of the tractor and the screed. The control system may have a speed control or throttle 142 for controlling the paving speed. The control system may include a conveyor control 144 to control the rate at which loose asphalt is delivered from the hopper to the augers. The control system may also include auger controls 146 that control the rate that the augers operate to spread the loose asphalt laterally across the ground behind the tractor and in front of the screed. Still other controls may be provided. In addition, an interface providing operator feedback for one or more systems may be provided and an adjustment mechanism may further be provided at the operator station 118.

Figure 3:
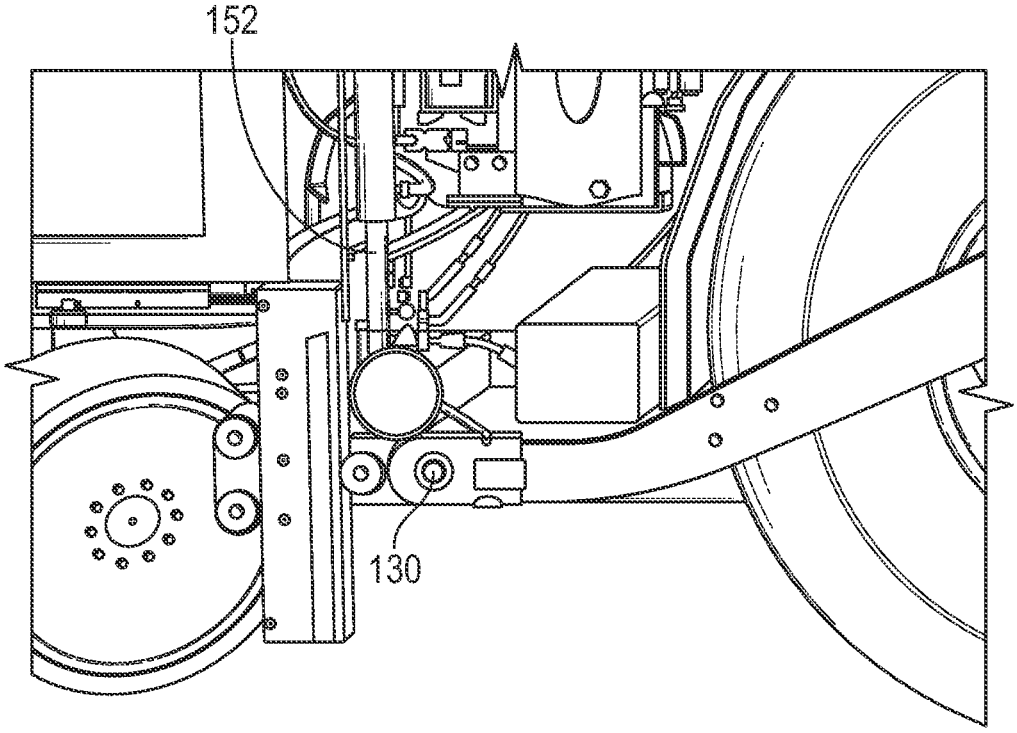
FIG. 3 is a close-up side view of the asphalt paver showing a tow point of a screed attached to a tractor, according to one or more embodiments.

The control system 132 may also include an automatic tow point control system 134 that controls the position of the tow points on the sides of the tractor. For example, the screed arms 120 may be connected to the tractor 102 at a tow point 130, but the tow point 130 may be moveable vertically along the sides of the tractor 102 so as to be able to control the angle of attack of the screed 104. In one or more embodiments, and as shown in FIG. 3, the tow point 130 may include a laterally extending pin that extends through a bore on the screed arm 120 and the pin may be moveable along a track or other guide on the side of the tractor 102. As also shown, the pin position may be controlled by a hydraulic cylinder 152, for example, or a rack/pinion mechanism, or other positional control device may be used.

In one or more embodiments, an automatic tow point control system 134 may be provided. For example, and based on a variety of factors, the asphalt paving operator may make adjustments to the paving operation that may affect the smoothness of the resulting paving mat. The automatic tow point control system 134 may control the tow points to compensate for these adjustments by the paving operator. For example, where trucks delivering asphalt are backed up, an asphalt paver operator may be inclined to speed up the paving operation. This may cause the head of material in front of the screed to reduce because the augers are not keeping up and/or the friction on the screed may reduce. In any case, the screed may tend to drop due to the increased speed resulting in laying a thinner pavement. In one or more embodiments, the automatic tow point control system 134 may compensate for the increased speed by lifting the tow point 130 to increase the angle of attack of the screed 104 allowing more mix to pass under the screed, causing it to rise back up and maintain a constant mat thickness.

Figure 4:
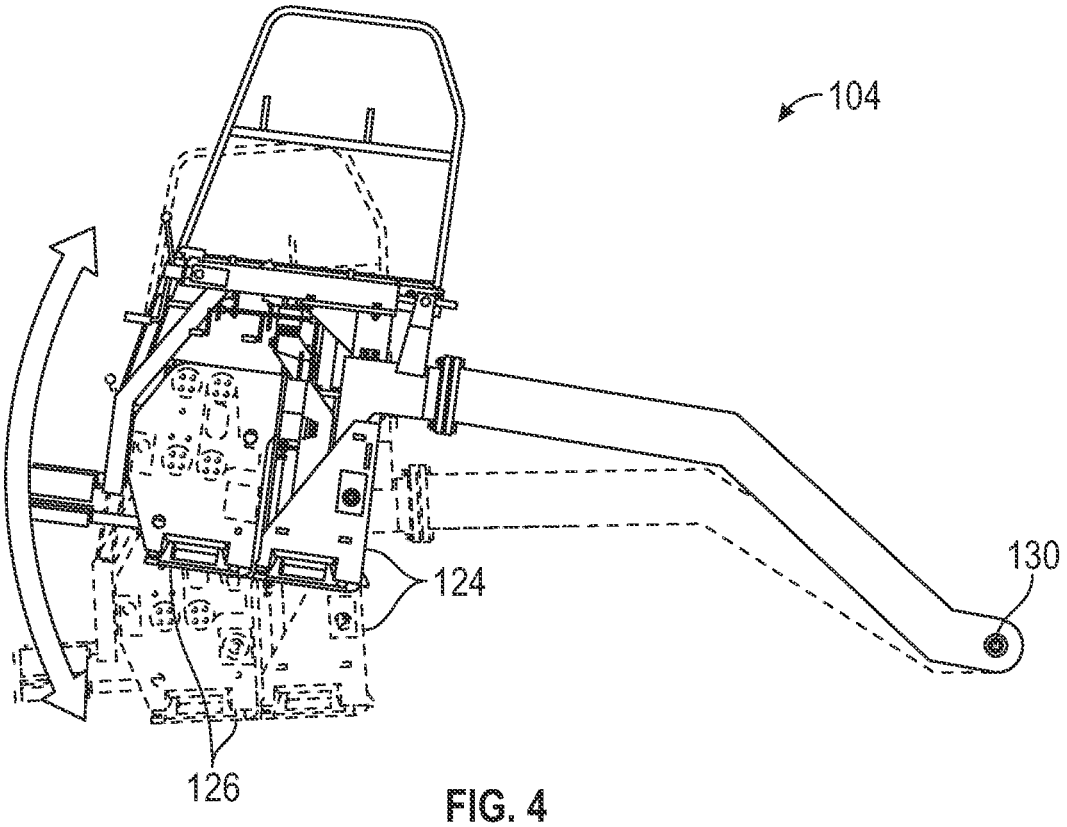
FIG. 4 is a side view of a screed and depicting pivoting motion of the screed about the tow point.
Figure 5:
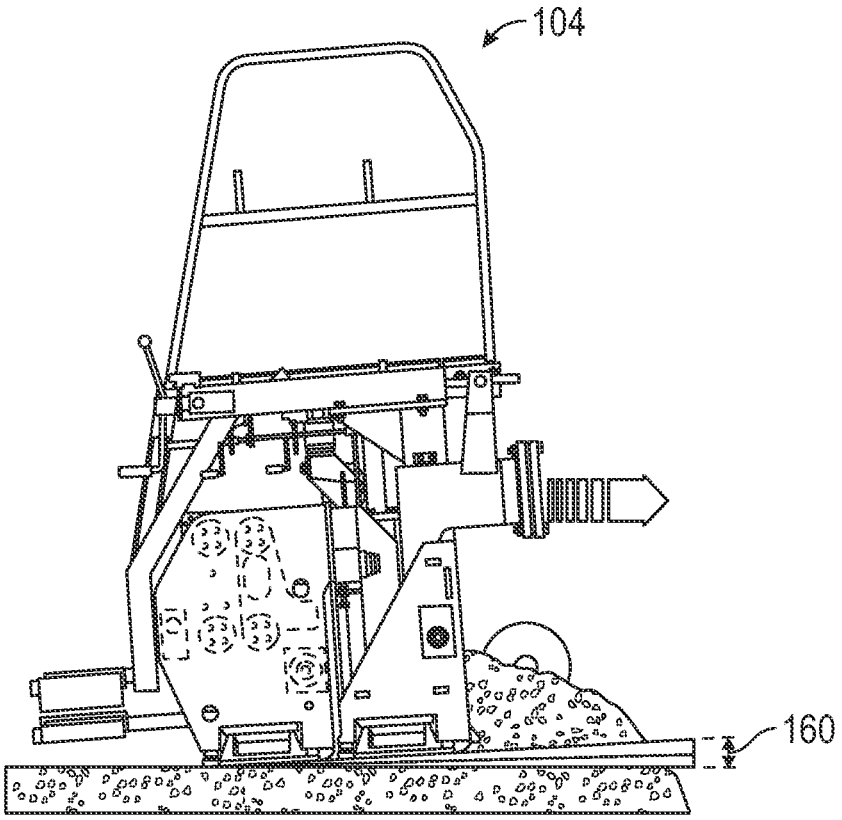
FIG. 5 is a cross-sectional view of a screed during a pavement operation and depicting an increased angle of attack, according to one or more embodiments.
Figure 6:
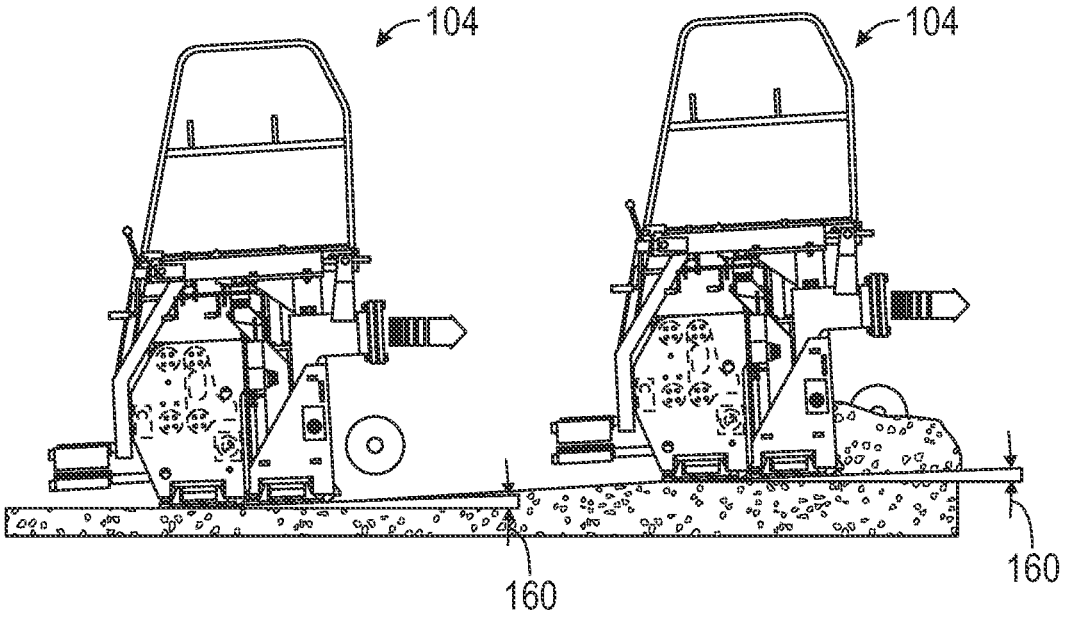
FIG. 6 is cross-sectional view of the screed of FIG. 5 and depicting the process the screed goes through to achieve equilibrium after the angle of attack is increased, according to one or more embodiments.

For a better understanding of the effects on the screed position and operation, a review of FIGS. 4-6 may be provided. That is, as shown in FIG. 4, the screed may be a free-floating screed that is pulled along by the tractor 102. Due to the pivoting nature of the screed arm connection to the tractor 102 at the tow point 130, the screed 104 may be free to rotate about the tow point 130 as shown. The forces on the screed throughout its operation that may tend to swing the screed 104 upward about the tow point 130 may include a material loading force acting rearwardly on the strike off plate 124 and friction acting along the surface of the screed plate 126. These forces may be increased or decreased based on particular operation selections. For example, if the operator operates the conveyors 114 at a relatively high rate relative to the paving speed, the head of material in front of the screed 104 may be relatively high and a relatively large rearward force on the screed 104 may be present. Still further, depending on the paving speed, the friction between the screed plate 126 and the paving mat may change accordingly. The forces acting on the screed 104 that may tend to swing the screed downward about the tow point 130 may include the weight of the screed 104 and the personnel present on the screed 104. These downward acting forces may be generally constant during the operation of the screed 104.

As shown in FIGS. 5 and 6, the automatic tow point control system 134 may compensate for other adjustments in paving by moving the tow point 130 up or down. In the case of compensating for an unwanted thinning of the asphalt mat, the automatic tow point control system 134 may compensate for adjustments such as increased speed or reduced material head in front of the screed 104 by moving the tow point 130 upward. As shown in FIG. 5, moving the tow point 130 upward may increase the angle of attack 160 of the screed 104, which may cause the screed 104 to ride upward on the asphalt material until it flattens out enough to reach equilibrium as shown in FIG. 6.

In one or more embodiments, an operator may desire to minimize movement of the tow points 130 by the automatic tow point control system 134. That is, for example, the operator may desire to avoid controlling the paver in a manner where compensation by the automatic tow point control system 134 is activated or the operator may desire to minimize or reduce compensation by the automatic tow point control system 134. This is because, and generally speaking, where operation of a paver can be performed in a way that tow point movement and adjustment can be reduced or minimized, a smoother pavement will result. It is to be appreciated that adjustments to the tow point change the angle of attack of the screed. Moreover, changes to the angle of attack in the screed take time and distance to pan out. For example, where the angle of attack is increased, the screed may have a tendency to ride up higher on the asphalt material being placed, which may result in creating a thicker mat. However, as the screed rides up on asphalt due to the increased angle of attack, the angle of attack flattens out again as the paver moves down the paving path. It takes particular amounts of time for the screed adjustment to take effect and controlling the paver in a manner that avoids the need to adjust the angle of attack provides for a smoother mat. For this purpose, the system may include a tow point monitoring and reporting system 136.

Figure 7:
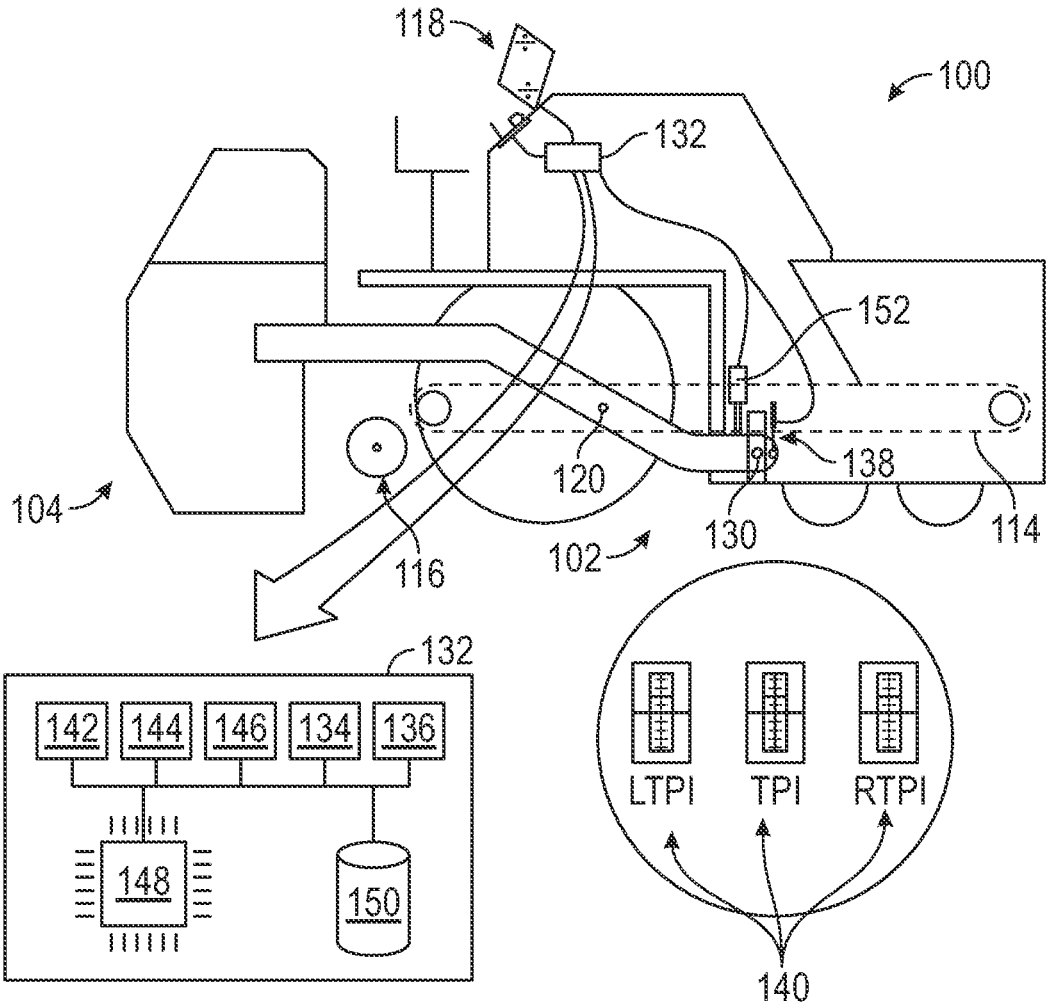
FIG. 7 is an electronic system diagram, according to one or more embodiments.
Figure 8:
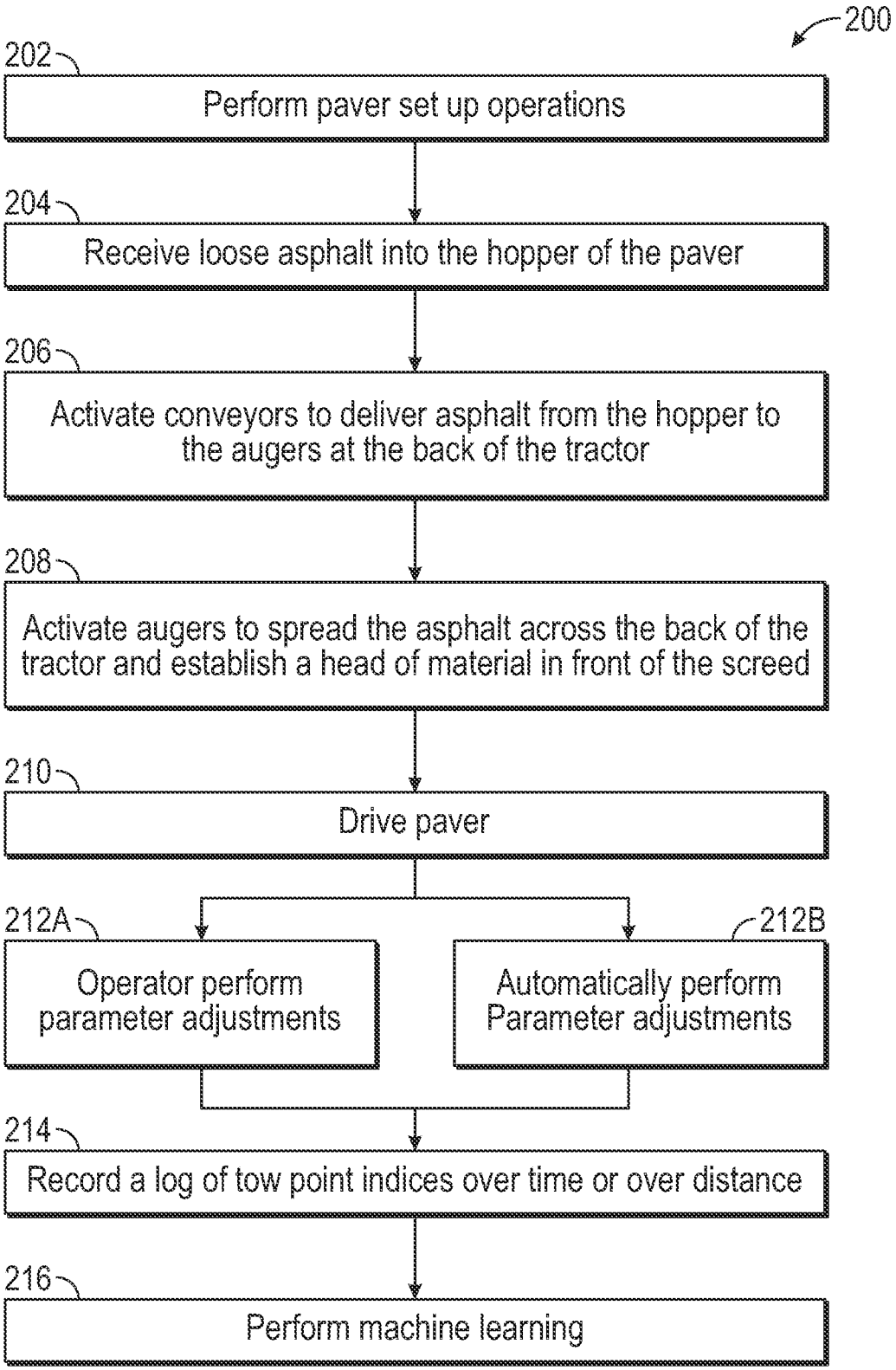
FIG. 8 is a diagram of a method of operating a screed, according to one or more embodiments.

As shown in FIG. 7, the monitoring and reporting system 136 may leverage the control system 132 on the paver and, for example, be a part of the electronic control module or may be a standalone computing system. Computer implemented instructions operable by a processor 148 may be stored in a computer readable storage medium 150 within the computing system of the machine for monitoring, analyzing, and presenting tow point information. The monitoring system 136 may include a sensor 138 at or near the tow points for continually, periodically, or selectively determining the tow point position. The sensor may, for example, include a yo-yo gauge, a smart hydraulic cylinder that includes a position monitor, or another type of sensor may be provided. The sensor 138 may be in wired or wireless communication with the electronic control module or other computing system such that the position of the tow point 130 may be communicated to the electronic control module or other computing device continuously or periodically.

The monitoring and reporting system 136 may be adapted to establish one or more tow point indices 140. For example, a right tow point index (RTPI), a left tow point index (LTPI), and a combined tow point index (TPI) may be provided. In one or more embodiments, a reference tow point position may be established by an operator such as at the beginning of a pavement project. In one or more embodiments, the operator station, for example, may include a zeroing feature that may allow an operator to zero out the tow point position after having adjusted the tow points 130 as desired for a given pavement operation. Thereafter, the monitoring and reporting system 136 may determine the tow point position relative to the reference position and provide the operator with an index showing the operator a variance from the reference position. For example, the index may range from −5 to 5, where 5 is 5 units above the reference position and −5 is 5 units below the reference position. Other ranges may be provided and the units may be actual units of measure or a normalized unitless index may be provided. As mentioned, a left, right, and combined index may be provided. For example, the left and right index may be presented after adjustment based on the reference position. The combined index may be an average index and the electronic control module may calculate the combined index. For example, the index from the left and the right may be added and the sum may be divided by two. The resulting indices may be presented to the operator of the asphalt paver 100 at the operator control station 118 on individual gauges or displays, or a display interface such as a computing screen may display the indices to the operator.

INDUSTRIAL APPLICABILITY

In operation and use, a user may perform a method of paving (200) while relying on the tow point index in an effort to reduce and/or minimize tow point movement. In one or more embodiments, the user may perform paver set up operations. (202) The paver set up operations may include placing lift blocks on the ground at or near the beginning of a paving operation. The lift block thickness may be selected to provide a screed height matching that of the anticipated height during paving operations. The screed may be lowered using a hydraulic system and rested on the lift blocks and placed in a free-floating condition where the screed is free to move upward and/or downward about the tow points based on paving forces counteracted by the weight of the screed and/or personnel present on the screed. Any additional adjustments for slope or grade may also be made. Set up operations may also involve selecting and/or planning for conveying speeds, auger speeds, and pavement speed, and other parameters affecting the grade and slope of the intended pavement mat. The asphalt paver may be turned on and any heating systems may be activated to warm up the paver for better handling of the asphalt material.

With setup complete, the operator may then receive loose asphalt into the hopper of the paver. (204) The loose asphalt may be received from a dump truck arranged on a front side of the tractor and/or from a conveying system arranged between a dump truck and a hopper, for example. The hopper may be loaded and additional asphalt from the dump truck or conveyor or from additional dump trucks may be present and waiting such that a relatively steady stream of asphalt may be provided to the asphalt paver.

With the hopper loaded with asphalt and settings on the paver selected for the particular paving operation, paving operations may begin. That is, for example, the conveyors may be activated to deliver asphalt from the hopper to the augers at the back of the tractor. (206) The augers may be activated to spread the asphalt across the back of the tractor and establish a head of material in front of the screed. (208) The asphalt paver may be driven forward at a selected speed based on a variety of factors including the desired thickness of the asphalt mat, the length of the pavement operation, the anticipated asphalt delivery rate from the plant, and other factors. (210) The conveyors and augers may be driven at a rate selected to compensate for the paving speed and, for example, at a rate that maintains the augers half full, for example. This particular rate of conveyor and auger delivery of asphalt may maintain a suitable head of material in front of the screed and, as such, cause the screed to maintain its angle of attack and deliver a suitable pavement thickness.

Throughout the paving operation, the operator of the paver may have a series of adjustable parameters at his or her disposal. Adjustments to any one or a combination of these parameters may have an effect on the forces acting on the screed and, as such, may tend to change the angle of attack of the screed. When this occurs, the automatic tow point adjustment system may attempt to compensate for changes in the angle of attack, by adjusting the tow points. For example, the paving operator may adjust the paving speed, the conveyor speed, the mix temperature, or the auger speed. These adjustments may affect the "drag" forces acting on the screed. For example, increased speed may reduce the frictional forces below the screed, but increase the material forces acting on the strike off plate. Increased conveyor speed may increase the head of material in front of the screed, which may increase the normal forces acting on the strike off plate. These changes in force on the screed may cause changes in the angle of attack of the screed. Other factors affecting the screed that the operator may have less control over may include the mix design of the asphalt, the air temperature, and the grade temperature. However, these factors may have less of a tendency to change throughout the paving operation and may often be planned for ahead of time.

During operation, the operator may make adjustments to one or more of the above-mentioned parameters. (212A) In some circumstances, adjustments may be in response to conditional changes outside of the operators control and the adjustments may be made to avoid fluctuations in the tow point index. For example, where the hopper of the paver is running low on asphalt material and a replenishing truck is not ready for refilling, the amount of material in front of the screed may begin to decrease. This may cause the screed to drop, thinning out the pavement mat. The automatic tow point control may raise the tow point to increase the angle of attack of the screed to compensate. This may be reflected by an increasing tow point index. In order to avoid this increasing index, the operator may preemptively slow the paver down. Alternatively, the operator may react to the increasing tow point index and slow the paver down responsive to the increasing tow point index. In some cases, the operator may bring the paver to a smooth, but abrupt stop if the tow point index becomes too great and to preserve a smooth mat. When additional material arrives, the operator may then smoothly, but abruptly bring the paver back up to speed.

In still another example, the paving operation may encounter a low point in the subgrade of the paving operation. The lowering of the material into the low point and in front of the screed may reduce the drag force on the screed, the screed may drop, and the automatic tow point control may raise the tow point to increase the angle of attack in an effort to get back to the thicker mat. The tow point index may, thus, increase. The paving operator may, again, slow the speed of the paver at this point to avoid the increase in the tow point index if the operator recognizes the low point in the subgrade ahead of time or the operator may slow the speed of the paver in response to the increasing tow point index. Still other situations may give rise to parameter adjustment by the operator preemptively to avoid fluctuations in the tow point index and/or in response to fluctuations in the tow point index.

While discussion of grade control has been provided, the tow point index may indicate changes on each side of the paver as well and adjustments to the paving parameters may be specific from side to side. Accordingly, the slope across the pavement may be continually reviewed and observed and, for example, where a particular side of the paving operation is running too thin, an auger on that side of the paver may have its speed increased to increase the amount of asphalt getting to that side of the paver.

In one or more embodiments, a log of tow point indices over time or over distance may be kept by the system. (214) This log may be compared to smoothness testing and correlations between tow point position and smoothness may be tested, analyzed, and considered for further paving operations. Moreover, a log of paving parameters and paving conditions may also be kept such that changes in paving parameters or conditions may be correlated to changes in the tow point index and to pavement smoothness.

In one or more embodiments, parameter adjustments may be performed automatically based on a tow point index. (212B) That is, for example, in one or more embodiments, the electronic control module may include computer readable instructions adapted to adjust paving parameters in consideration of the tow point index. For example, and in addition to an automatic tow point adjustment system, an automatic parameter adjuster may be provided and calibrated with a goal of avoiding adjustment by the automatic tow point adjustment system. In one or more embodiments, a plurality of sensors may be provided to gather data for the automatic parameter adjuster. In one or more embodiments, a material head sensor, a subgrade sensor, a hopper material sensor, an attack angle sensor, or other sensors may be available. These sensors may be in addition to a speedometer, tow point sensor, or other sensors on the paver. The automatic parameter adjuster may rely on one or more of the paver sensors and attempt to maintain paving conditions as consistent as possible to avoid adjustment of the tow point by the tow point adjustment system. In one or more embodiments, the automatic parameter adjuster may look for inconsistencies in the paving conditions preemptively and may attempt to compensate for these inconsistencies without being triggered by movement of the tow point index. In other embodiments, the automatic parameter adjuster may look for inconsistencies, but wait to compensate until the inconsistencies amount to something sufficient to cause the tow point index to change. In still other embodiments, each parameter or condition may have a range of acceptable values and the automatic parameter adjuster may compensate for inconsistencies in the parameters when the parameters fall outside of the acceptable range.

For example, where the material head sensor senses that the head of material in front of the screed is low, the automatic parameter adjuster may recognize this as an inconsistency in a pavement condition. In one or more embodiments, the automatic parameter adjuster may investigate the reason for the low head, such as reviewing the amount of material in the hopper (i.e., because the material may be low), reviewing the subgrade (i.e., because the a depression may be present). The head of material in front of the screed may have an effect on the angle of attack of the screed and where the head reduces, this may commonly cause an increase in the angle of attack due to the dropping of the screed and a thinner pavement mat being placed. Due to this reduced mat thickness, the automatic tow point adjustment system may further increase the angle of attack by lifting the tow point. In one or more embodiments, if the automatic parameter adjuster recognizes a reduced head of material and begins to see an increase in the tow point index as a result, the automatic pavement adjuster may increase the conveyor speed to refill and/or regain a suitable head of material or the automatic pavement adjuster may reduce the speed of the paver, for example, to allow the current conveyor speed to refill or regain a suitable head of material. In other embodiments, rather than waiting for a change in the tow point index, the automatic parameter adjuster may compare the sensed amount of material in front of the screed and compare it to a range. For example, where the head of material in front of the screed reduces from half way up the auger to ⅓ of the way up the auger or ¼ of the way up the auger, the automatic pavement adjuster may perform the conveyor speed adjustment or the paving speed adjustment without waiting for a change in the tow point index.

In another example, if the pavement width is adjusted, the area of uncompacted material supporting the screed changes. When the pavement width is increased, the area of uncompacted material supporting the screed increases, which tends to lift the screed and decrease the angle of attack. To compensate for the lifted screed and the resulting thicker mat, the automatic tow point adjustment system may react by lowering the tow point to decrease the angle of attack and get back to the thinner mat. When the pavement width is decreased, the area of uncompacted material supporting the screed decreases, which tends to lower the screed and increase the angle of attack. To compensate for the lowered screed, the automatic tow point adjustment system may react by lifting the tow point to increase the angle of attack and get back to the thicker mat.

The automatic parameter adjuster may function in response to the changes in the tow point index or may preemptively function to avoid changes in the tow point index. In the case of reacting to the tow point index, when the tow point changes due to pavement width adjustments, the automatic parameter adjuster may make changes in response to the tow point index movement. For example, in the above example, the tow point is lowered to compensate for an increased pavement width and a resulting thicker mat. When the automatic parameter adjuster sees the lowered tow point, it may speed up paving to provide a thinner mat, which will allow the tow point to return to its original position. Alternatively, the automatic parameter adjuster may reduce the auger speed to reduce the head of material in front of the screed causing the screed to drop to the thinner mat thickness and allowing the tow point to return to its original position. The opposite may be performed (e.g., slower speed/increased material head) for situations when the pavement width is decreased. Preemptively, the automatic parameter adjuster may function in response to the thinner/thicker mats mentioned above without waiting for the tow point to adjust. This may function to prevent, reduce, or minimize tow point adjustment and, thus, provide a smoother mat.

Still another example of parameter adjustments that may be made automatically to reduce, avoid, or minimize tow point movement may relate to auger operation. For example, in some cases on/off auger movement may occur where the augers slow below 20 rpm or stop rotating completely. The head of material in front of the screed may fluctuate before the augers engage and resume turning to satisfy the demands of the sonic or mechanical feed sensor. This on/off auger movement may result in a wavy, uneven mat. In this condition, the tow point may continually adjust in an effort to compensate for the stops and starts and the resulting changes to the mat thickness. The automatic parameter adjuster may recognize the continual changes in the tow point and may intervene to operate the auger more consistently. As with the previous examples, the automatic parameter adjuster may do so in response to tow point adjustments or preemptively.

In one or more embodiments, the automatic parameter adjuster may perform machine learning (216) by capturing sensor data over time in addition to machine and/or operator reactions to the data and identifying patterns. In particular, the automatic parameter adjuster may look further upstream to paving conditions and attempt to identify patterns or items that lead to inconsistencies in the paving operation. With the identified patterns, the automatic parameter adjuster may begin to adjust machine parameters without waiting for an inconsistency in a pavement condition to fall outside of a range or without waiting for an inconsistency in a pavement condition to result in a change in the tow point index.

For example, in the case above where the material head in front of the screed decreased, it may have decreased for one or more reasons. As mentioned, the material in the hopper may have been low or there may have been a depression in the subgrade, for example. In one or more embodiments, the automatic parameter adjuster may perform machine learning by capturing sensor data that leads to inconsistencies in paving conditions and it may identify patterns in the sensor data allowing the automatic parameter adjuster to make changes to the paving parameters before or at the time when the inconsistency may otherwise develop. For example, in the present case of a decreasing head of material in front of the screed, the automatic parameter adjuster may rely on low hopper material, low subgrade, or a combination of both to adjust the auger speed or the speed of the machine before an inconsistency in the head of material in front of the screed develops.

Similarly, in the case of a change in the pavement width, the automatic parameter adjuster may, overtime, learn what the effect of a change in the pavement width does to the pavement thickness and how the system reacted to compensate for a change in the tow point or to avoid a change in the tow point and the system may adjust the auger speed or the speed of the machine before an inconsistency in the mat thickness develops. In short, the machine learning may provide for the ability of the system to look further upstream at conditions that tend to result in an inconsistency in a paving condition and may compensate for the upstream condition before the inconsistency develops.

In another example, if the paver operator slowly accelerates and decelerates the paver in between truckloads of mix on a consistent basis and this operation is related to a localized (in time and space) high tow point index number, the automatic parameter adjuster could automatically control the acceleration and deceleration of the paving machine after the operator moves the propel lever out of, or towards neutral, thus minimizing the effect of slow acceleration and deceleration of the paving machine on mat smoothness. This pattern of behavior could be logged continuously and after meeting a certain threshold for repeated behavior, the automatic parameter adjuster could be engaged to control acceleration and deceleration of the paver once the propel lever starts to leave neutral or starts a return to neutral. Accordingly, in this case, the upstream conditions that may relate to an uneven pavement include the acceleration and deceleration rates of the paver, which cause inconsistencies in a paving condition (e.g., screed height).

Still another example of machine learning relates to the operation pattern of folding the hopper wings. This patter may be logged and correlated with variability or spikes in the tow point index. Hopper level sensors (level of mix in the hopper) may monitor the level at which the paver operator folds the wings and correlate this with the tow point index. The operator may intentionally, or unintentionally vary the timing of folding the hopper wings at various mix levels in the hopper and the automatic parameter adjuster may establish, through correlation, the optimum (minimum tow point index) time to fold the hopper wings. The system may provide this optimum time to fold the wings to the operator or may automatically take control of the operation of folding the hopper wings. In this case, the upstream condition may include hopper wing folding times, which may relate to an inconsistency in a paving condition of the head of material in front of the screed.

In summary, the automatic parameter adjuster may operate in one or a combination of modes described above. First, it may operate reactively to adjustments to the tow point. Second, it may operate preemptively based on paving conditions to avoid, reduce, or minimize tow point adjustment. Third, it may operate in a machine learning mode where it identifies patterns of upstream conditions that tend to lead to inconsistent paving conditions and may make machine adjustments before the inconsistent paving condition develops and, as such, before the automatic tow point adjuster performs an adjustment.

The above detailed description is intended to be illustrative, and not restrictive. The scope of the disclosure should, therefore, be determined with references to the appended claims, along with the full scope of equivalents to which such claims are entitled.

What is claimed is:

1. An asphalt paver, comprising:

a tractor;

a screed configured for towing behind the tractor, the screed comprising a tow arm secured to the tractor at an adjustable tow point; and a monitoring system configured for monitoring and displaying the position of the adjustable tow point and comprising:

a sensor arranged at or near the tow point for sensing the position of the tow point; and a computing system in communication with the sensor for displaying the position of the adjustable tow point.

2. The paver of claim 1, wherein the position of the adjustable tow point is in the form of a tow point index.

3. The paver of claim 2, wherein the tow point index defines a position relative to a reference position.

4. The paver of claim 2, further comprising an automatic parameter adjuster configured work in conjunction with the monitoring system to reduce or minimize movement of the tow point by adjusting a parameter of the asphalt paver.

5. The paver of claim 4, wherein the parameter is at least one of paving speed and conveyor rate.

6. The paver of claim 4, wherein the automatic parameter adjuster is configured to function in response to the tow point index.

7. The paver of claim 4, wherein the automatic parameter adjuster is configured to look for inconsistencies in the paving conditions and function preemptively to avoid changes in the tow point index.

8. The paver of claim 7, wherein automatic parameter adjuster comprises a machine learning component that identifies patterns relating paving conditions to changes in paving parameters and adjusts a paving parameter based on one or more of the patterns.

9. The paver of claim 1, wherein the tow point index comprises a plurality of indices.

10. The paver of claim 9, wherein the plurality of indices comprises a left index, a right index, and a combined index.

11. The paver of claim 10, wherein the combined index comprises an average of the left index and the right index.

12. A method of operating an asphalt paver, comprising:

operating the asphalt paver to receive loose asphalt, deliver the loose asphalt to the grade in front of a screed, and pull the screed to form an asphalt mat, the operating comprising setting and/or adjusting an operating parameter including at least one of paver speed and conveyor delivery rate; and continually receiving a tow point index from a monitoring system and adjusting the operating parameter to limit fluctuations in the tow point index.

13. The method of claim 12, wherein when the tow point index goes down, adjusting the operating parameter comprises reducing the paving speed or increasing the conveyor delivery rate.

14. The method of claim 12, wherein adjusting the operating parameter is performed automatically.

15. The method of claim 12, wherein adjusting the operating parameter comprises identifying a pattern relating paving conditions to changes in paving parameters and adjusting a paving parameter based on one or more of the patterns.

16. The method of claim 12, wherein the tow point index comprises a tow point position relative to a reference position.

17. The method of claim 16, wherein the tow point index comprises a plurality of indices including a left index, a right index, and a combined index.

18. The method of claim 17, wherein adjusting the operating parameter comprises adjusting the operating parameter responsive to changes in the tow point index.

19. The method of claim 18, wherein adjusting the operating parameter comprises adjusting the operating parameter preemptively to avoid changes in the tow point index.

20. The method of claim 17, wherein adjusting the operating parameter is performed based on differing indices on a left side and a right side of the paver.

* * * * *